US005637021A

United States Patent [19]

Watanabe

[11] Patent Number: 5,637,021

[45] Date of Patent: Jun. 10, 1997

[54] CONTROL FOR OUTBOARD MOTOR

[75] Inventor: Hitoshi Watanabe, Hamamatsu, Japan

[73] Assignee: Sanshin Kogyo Kabushiki Kaisha, Hamamatsu, Japan

[21] Appl. No.: 503,993

[22] Filed: Jul. 19, 1995

[30] Foreign Application Priority Data

Jul. 19, 1994 [JP] Japan ..... 6-166865

[51] Int. Cl.[6] ..... B63H 20/32

[52] U.S. Cl. ..... 440/77; 440/113; 24/621; 174/152 G

[58] Field of Search ..... 440/76–78, 84, 440/86, 88, 89, 113; 123/195 C, 195 P; 24/621; 174/152 G, 153 G, 65 G

[56] References Cited

U.S. PATENT DOCUMENTS 2,517,717 8/1950 Rose ..... 174/152 G 3,162,412 12/1964 Mc Entire ..... 174/153 G 4,864,080 9/1989 Fochler et al. ..... 174/65 G

FOREIGN PATENT DOCUMENTS 0020794 1/1987 Japan ..... 440/77

*Primary Examiner*—Jesus D. Sotelo

*Attorney, Agent, or Firm*—Knobbe, Martens, Oslon & Bear LLP

[57] ABSTRACT

Embodiments of restraining grommets for use with protective cowling of marine outboard drives through which various flexible elements such as control cables and hoses extend. The restraining grommet is formed with at least two openings made up of multi-part sections and at least one of which is slitted so as to permit ease of insertion and removal of the flexible element without kinking of them.

7 Claims, 9 Drawing Sheets

CONTROL FOR OUTBOARD MOTOR

BACKGROUND OF THE INVENTION

This invention relates to a control for a marine propulsion device and more particularly to a control for an outboard motor.

In many forms of marine propulsion devices, the propulsion device is mounted at the rear of the watercraft on the transom and contains certain mechanism within a protective cowling. In the case of an outboard motor, this mechanism may constitute an internal combustion engine transmission controls and various other auxiliaries for the propulsion unit. In the stern drive portion of an inboard/outboard drive, the outboard propulsion unit may include a transmission and other auxiliaries. In each instance, there are a number of devices that must pass through the protective cowling so as to either supply fluids to or from the outboard unit or to accommodate controls.

For example, with an outboard motor there may be a fuel supply line that connects the fuel system of the engine within the protective cowling with a remotely positioned fuel tank in the hull of the watercraft. Frequently, these fuel systems employ return lines for returning fuel back to the remotely positioned tank. Also, there may be oiling systems that employ remotely positioned oil tanks and these also may require delivery and/or delivery and return conduits that pass through the protective cowling. In addition, various bowden wire actuators or other types of flexible transmitters may be required. For example, a throttle control and a transmission control frequently penetrate the protective cowling for operating the throttle and transmission.

In all of these instances, it is desirable to provide an arrangement wherein the various conduits or transmitters, hereinafter referred to in both the specification and claims as flexible elements, should pass through the protective cowling and be sealed thereto. Normally, elastic sealing grommets are employed for this purpose. If a separate grommet is provided for each flexible element, then the construction becomes rather objectionable in appearance. Furthermore, the use of such plural holes in the protective cowling gives rise to an objectionable construction and one which is expensive to manufacture.

In addition to these difficulties, it is frequently necessary to disassemble and reassemble the arrangement. It is well known that it is difficult to feed these various flexible elements through the grommets, particularly if they are in place in the protective cowling. Frequently, attempts at such installation and removal causes damage to the flexible conduits.

Also, it is desirable that the flexible conduit, protective cowling, and grommet provide a tight seal. This is desirable to ensure that water cannot inadvertently seep into the interior of the protective cowling and damage the conduits and components therein.

It is, therefore, a principal object of this invention to provide an improved control arrangement for a marine outboard propulsion unit.

It is a further object of this invention to provide an improved sealing grommet assembly for such an application.

It is a yet further object of this invention to provide such a sealing grommet connection that permits ease of installation and removal of the various flexible elements and maintains good sealing.

It is a further object of this invention to provide an improved grommet arrangement for such an application that can pass plural flexible elements and ensure good sealing and ease of replacement.

SUMMARY OF THE INVENTION

This invention is adapted to be embodied in a restraining grommet for an outboard propulsion device having a protective cowling with an opening in which the restraining grommet is affixed. The restraining grommet is formed from an outer body of a resilient material and having at least one hole that extends longitudinally through the outer body from one end face to the other for passing an elongated flexible element between the interior of the protective cowling and the exterior thereof with the restraining grommet retained in the protective cowling opening. A slit extends from the hole to the outer periphery of the restraining grommet for resilient opening of the hole to insert the flexible elongated element into the hole in a transverse direction.

DETAILED DESCRIPTION OF THE PREFERRED EMBODIMENTS

Figure 1:
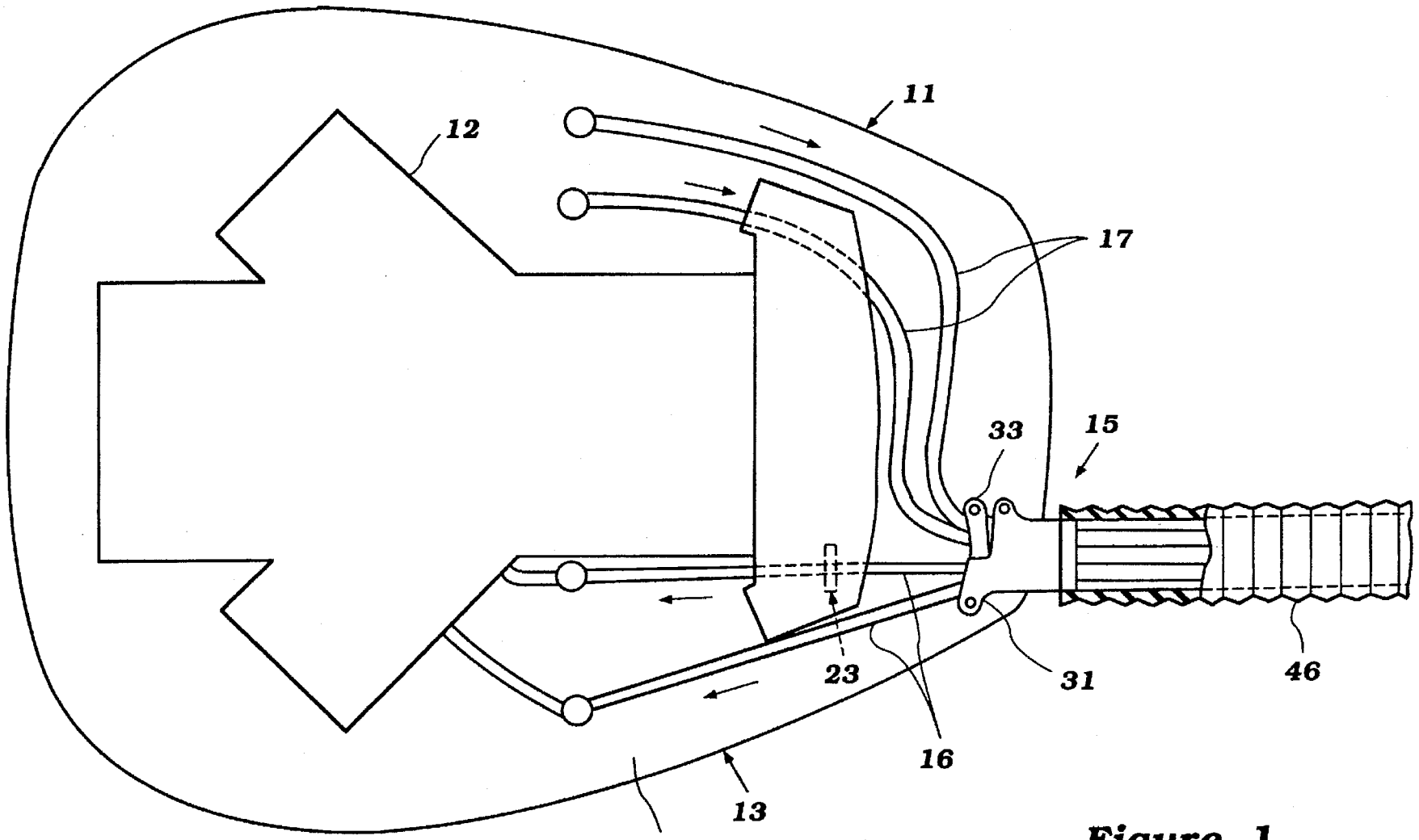
FIG. 1 is a partially schematic top plan view of an outboard motor constructed in accordance with an embodiment of the invention, with portions broken away and other portions shown schematically.
Figure 2:
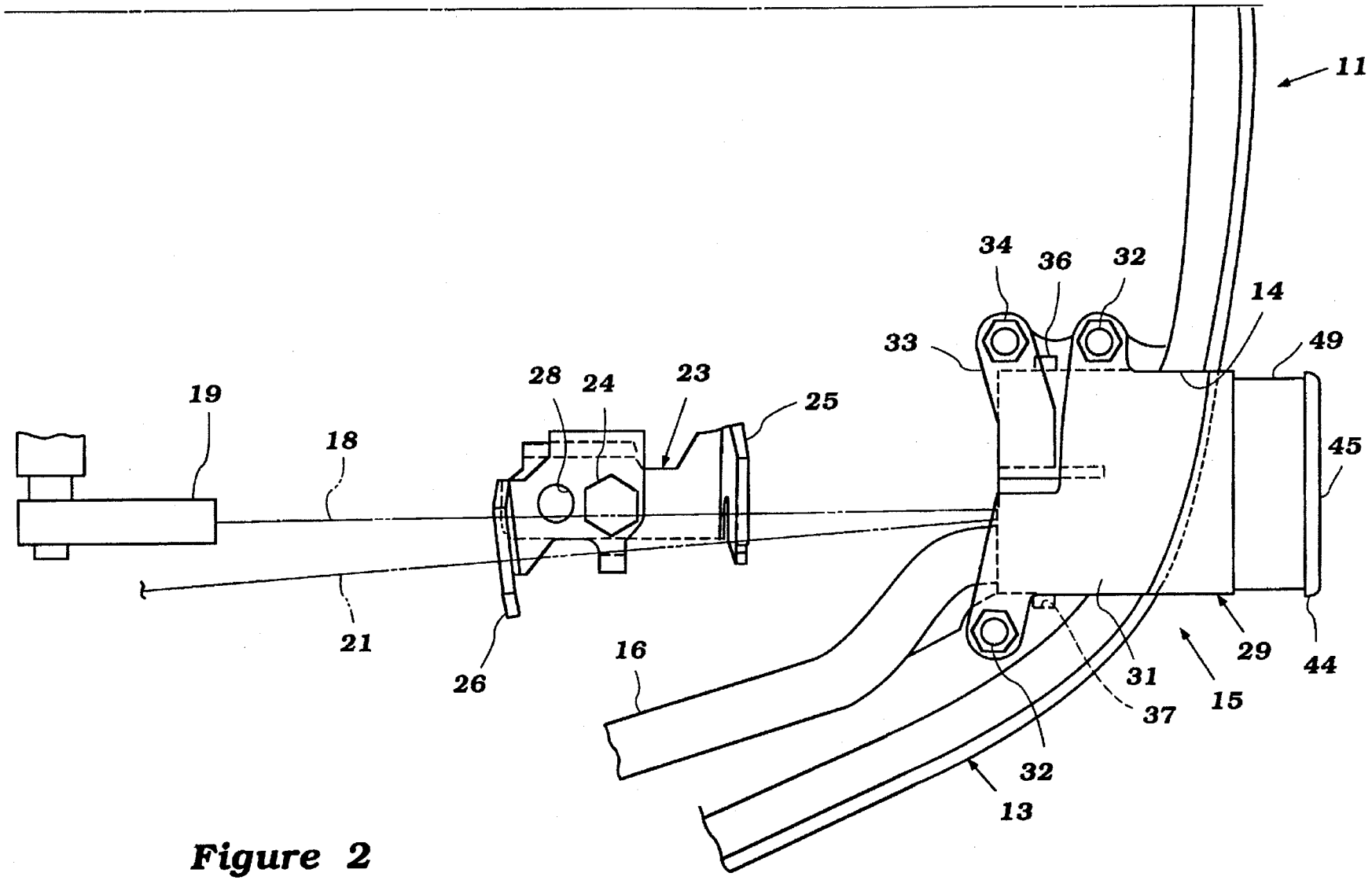
FIG. 2 is an enlarged top plan view, looking in the same direction as FIG. 2, but showing the components more in their actual appearance.
Figure 3:
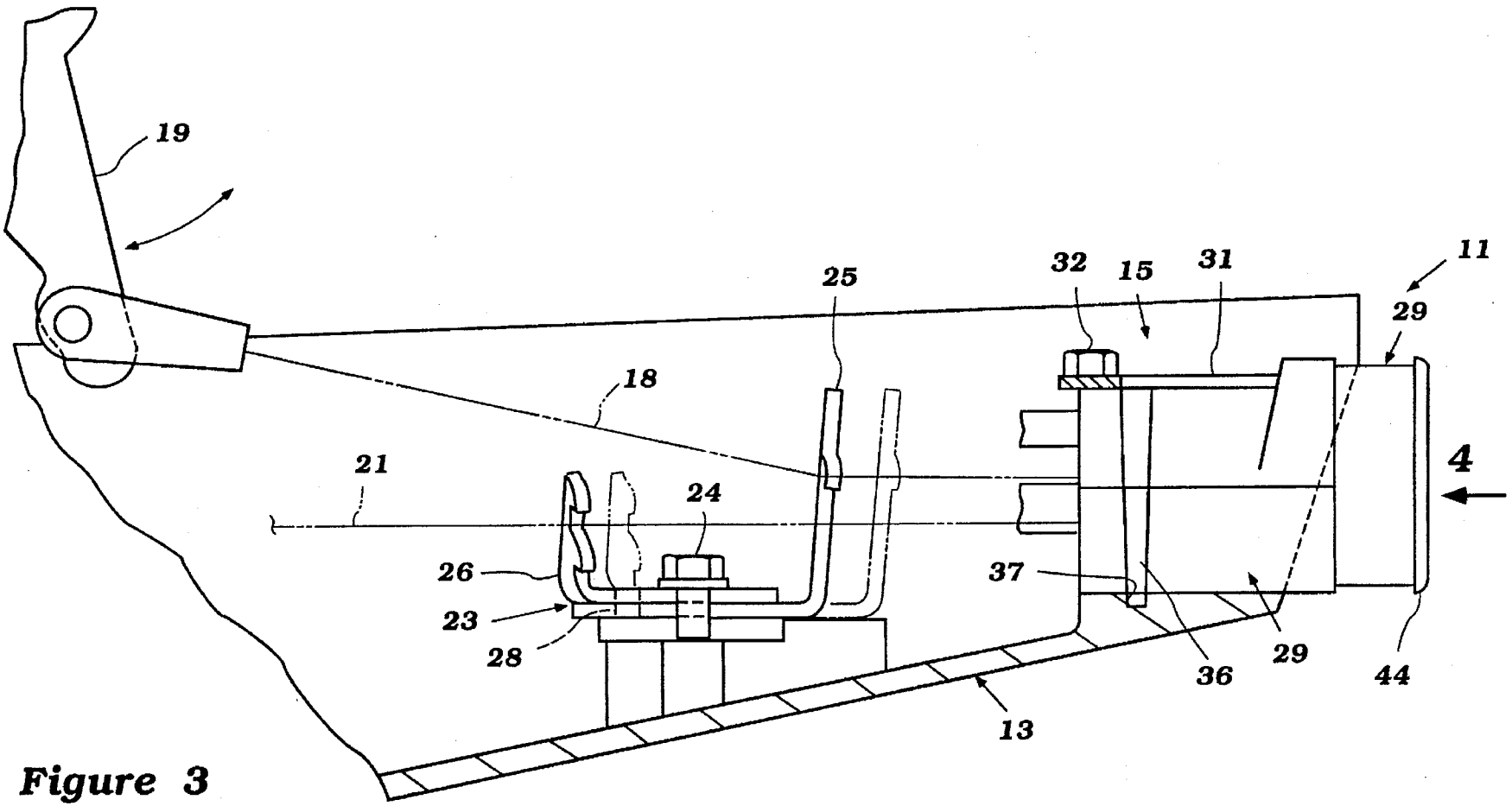
FIG. 3 is a cross-sectional view taken along a plane perpendicular to the plane of FIG. 2 and showing the same components therein.

Referring in detail to the drawings and initially to FIGS. 1–3, a power head of an outboard motor is shown partially and, in some instances, schematically and is indicated generally by the reference numeral 11. As is well known in this art, the power head of an outboard motor includes, normally a powering internal combustion engine and a surrounding protective cowling. As should be apparent from the foregoing description, the invention deals with the way in which certain flexible elements extend through the protective cowling and are sealed therein. Therefore, the basic components of the power head are shown, if at all, generally schematically and these include an engine 12 which is supported, as is typical with outboard motor practice, so that its output shaft rotates about a vertically extending axis.

This engine 12 is surrounded by a protective cowling which is comprised of a lower tray portion 13, normally formed from a relatively rigid, lightweight material, such as aluminum or aluminum alloy and which underlies in part the engine 12. An upper main cowling portion (not shown) is detachably fixed to the tray 13 and completes the enclosure of the engine 12. Since in the illustrated embodiment, the flexible elements are passed through the tray 13, only that portion of the cowling is shown. It will be readily apparent to those skilled in the art, however, how the invention may be applied if the components pass through the main cowling member. Passage through the trays 13 is preferred, however, because it provides a neater assembly and also provides a more rigid element so that sealing can be improved.

The forward portion of the tray 13 is provided with a slot 14 through which certain flexible elements, to be described, pass in sealing relationship with a grommet assembly, indicated generally by the reference numeral 15 and which will be described in more detail later by reference to the additional figures.

As has been noted, the flexible elements may take any of a wide variety of types. For example, they may include a pair of flexible fuel supply hoses 16 which supply fuel from a tank positioned in the hull of the watercraft to the charge forming system for the engine. In addition, return conduits 17 may run back to the remote tank from a pressure regulator or the like. In addition, various wire actuators such as a bowden wire throttle control 18 may pass through the opening 14 and be connected in a well known manner to a throttle control lever 19 of the engine for remote engine speed control. In addition, a bowden wire actuator 21 for operating the transmission control of the lower unit of the outboard motor may also be employed and passed through the opening 14 and be retained by the retaining assembly 15. In this regard, the description thus far has been of that of an outboard motor but it should be understood that similar arrangements may also be employed with the outboard drive portion of an inboard/outboard drive.

Figure 4:
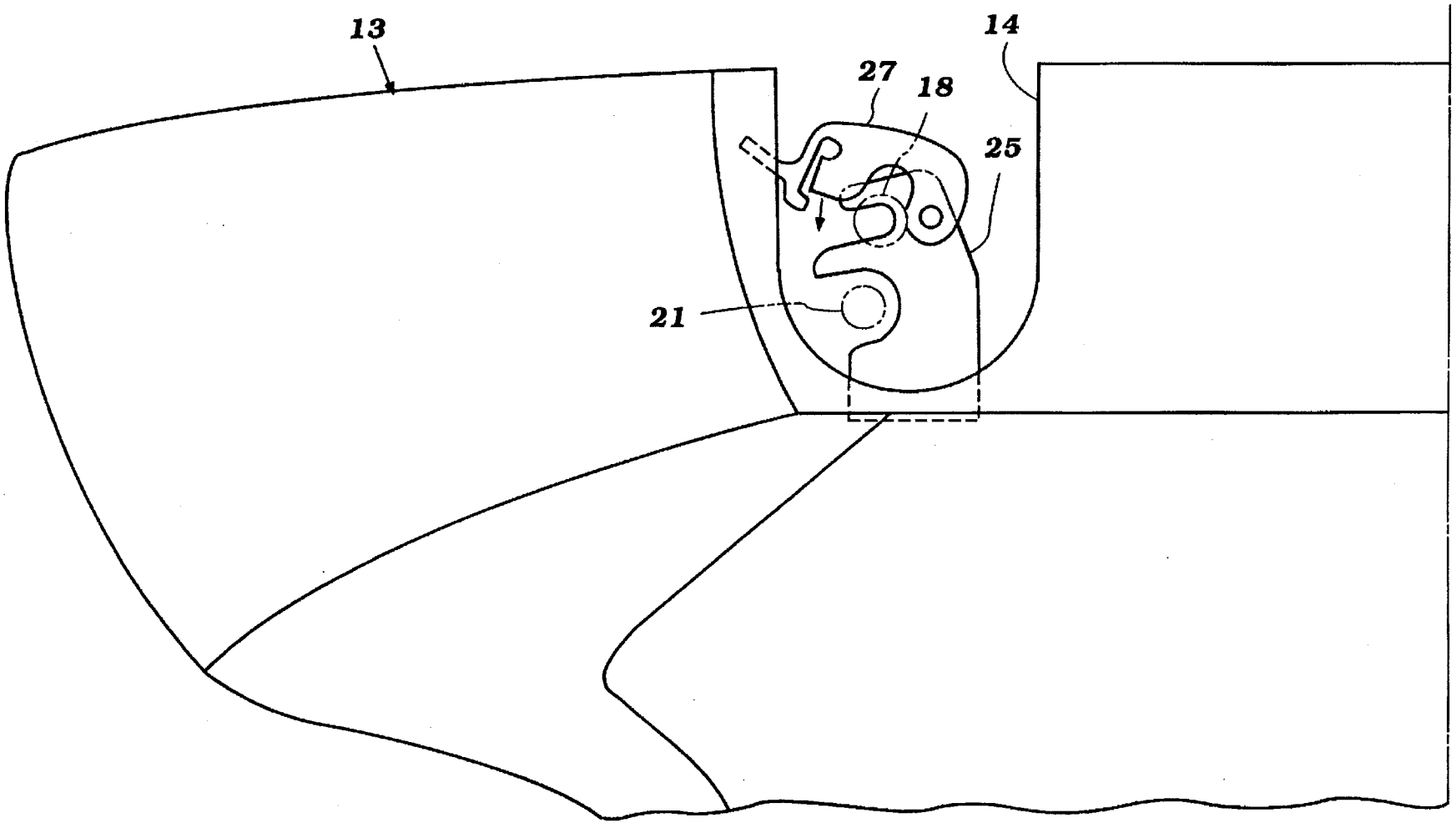
FIG. 4 is a front elevational view looking in the direction of the arrow 4 in FIG. 3 but with the grommet and restraining assembly as well as the flexible elements removed so as to more clearly show the construction.

The wire actuators 18 and 21 are restrained within the interior 22 of the protective cowling by a retaining bracket assembly 23. This bracket assembly 23 has a base portion that is held in place by a threaded fastener 24 and which may be made of either one or a pair of oppositely shaped L-shaped members. In the illustrated embodiment, the latter two-piece construction is described and it includes a first bracket 25 that has a forward opening slot as shown in FIG. 14 through which the wire actuators 18 and 21 extend. A rear bracket member 26 also has a similar pair of slots for passing the wire actuators 18 and 21. If desired, a pivotally supported latch member 27 may be carried by one or both of the bracket portions 25 and 26, as shown in FIG. 4, so as to releasably restrain the wire actuators 18 and 21 within the respective grooves thereof.

The brackets 25 and 26 may be provided with a further aperture 28 that can accommodate another fastener or which may accommodate a different type of mounting arrangement or adjustment between the various brackets 25 and 26. The phantom line view of FIG. 3 shows how the brackets 25 and 26 may be repositioned in a more forward direction from that shown in the solid line view.

Figure 6:
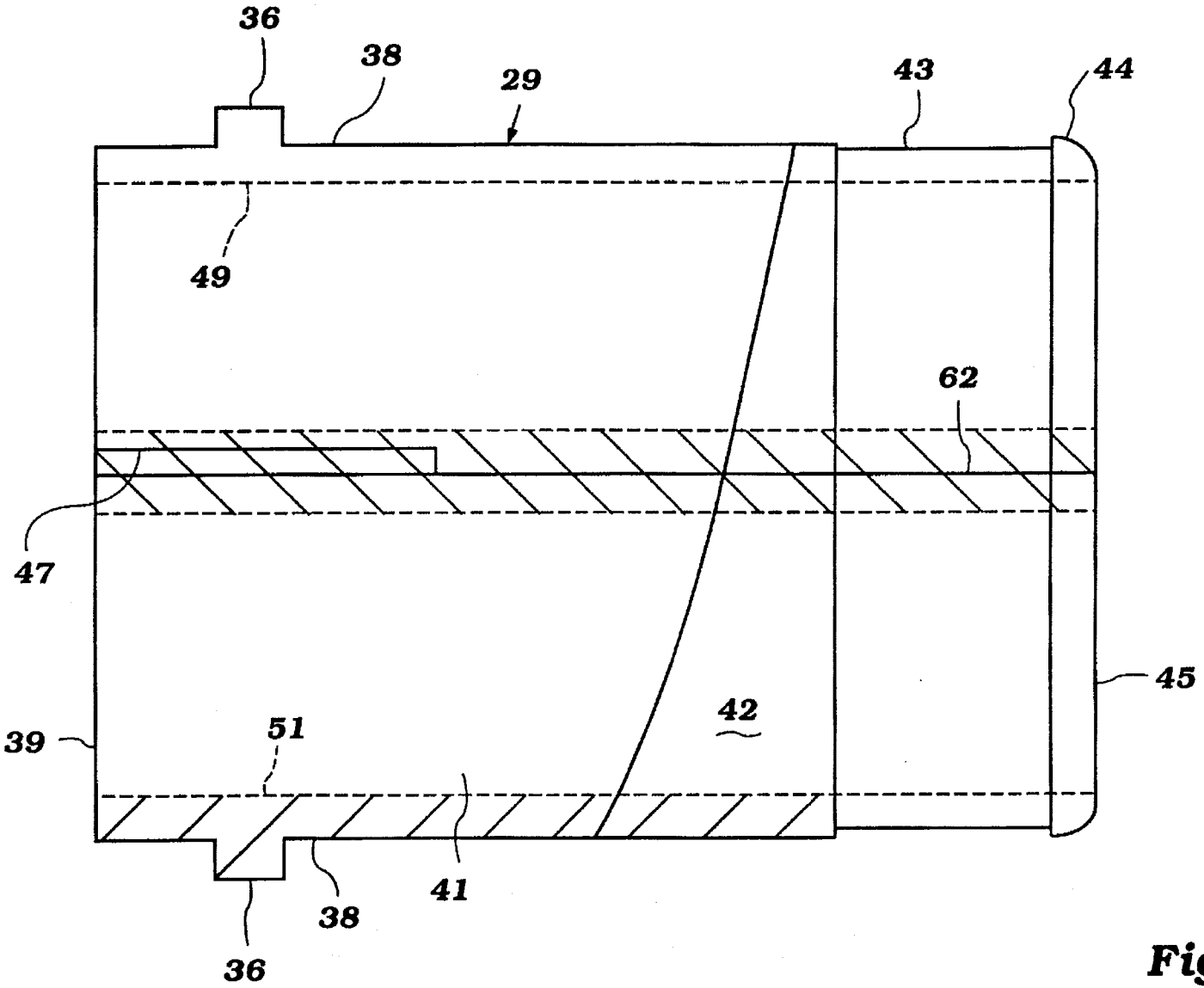
FIG. 6 is a top plan view of the restraining grommet, with portions broken away and other portions shown in phantom.
Figure 7:
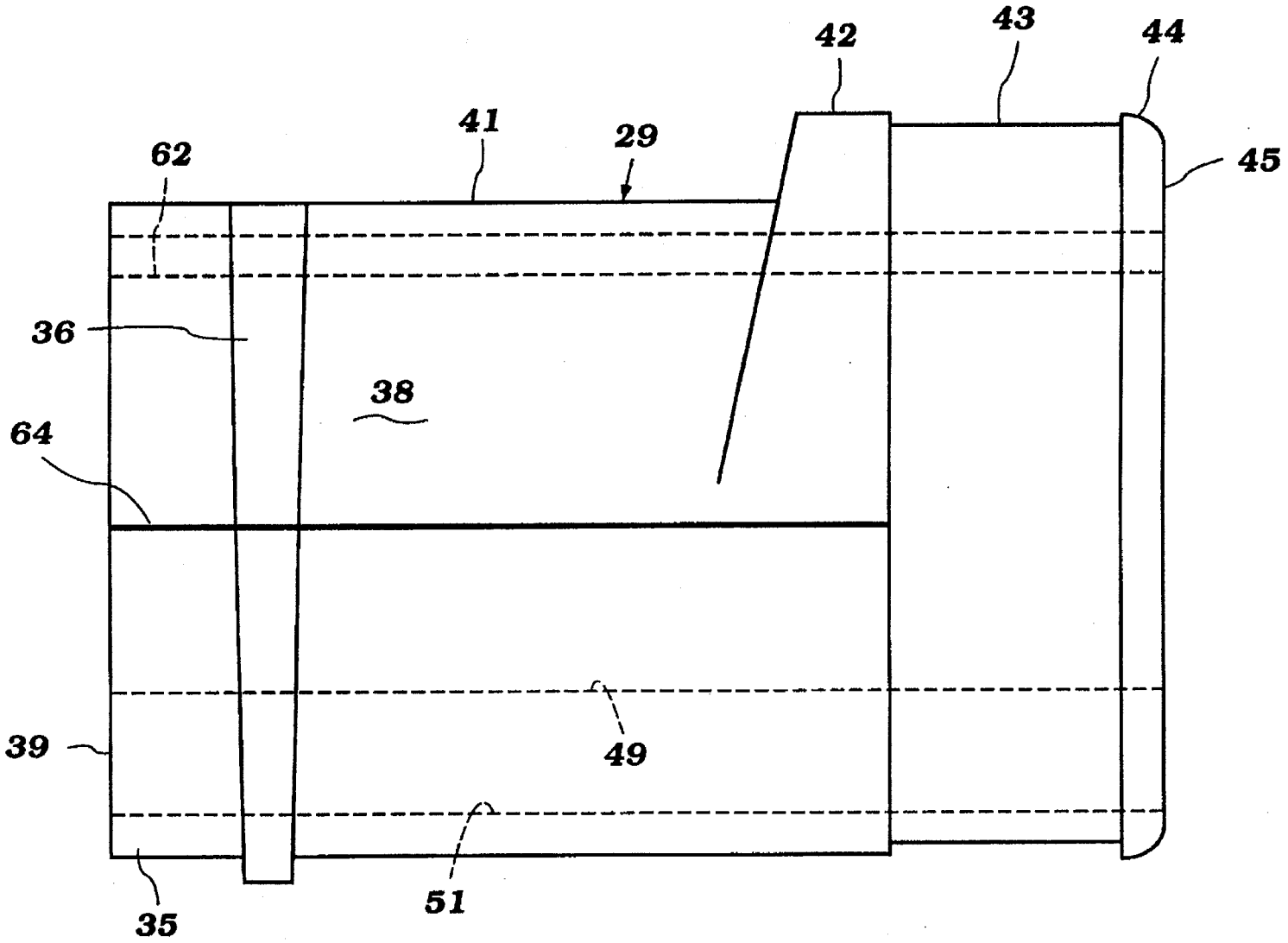
FIG. 7 is a side elevational view of the restraining grommet.
Figure 8:
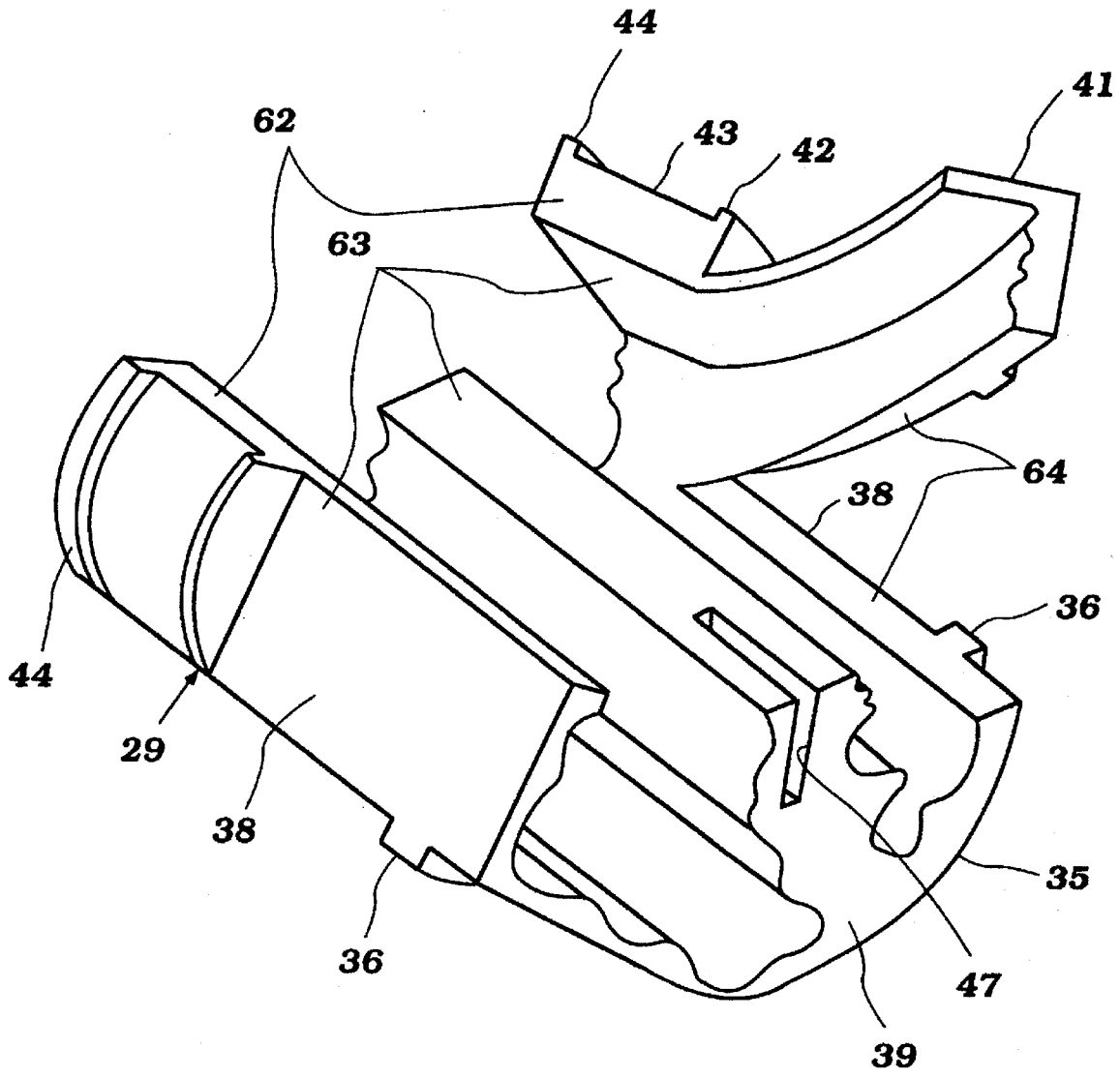
FIG. 8 is a perspective view of the grommet, showing it folded to an open position wherein the flexible elements may be removed or installed.

The restraining assembly 15 is comprised of an elastic grommet, indicated generally by the reference numeral 29 and having a construction as will be described by primary reference to FIGS. 6–8. In addition to this grommet 29, there are provided a clamping plate 31 which holds the grommet 29 to the tray 13 by means of threaded fasteners 32 and which compresses the grommet 27 to retain the flexible elements 16, 17, 18, and 21 therein. In addition, a locating bracket 33 cooperates with the grommet 29 in a manner to be described so as to prevent its rotation. This locating bracket 33 is held in place on the tray 13 by a further threaded fastener 34.

The configuration of the elastic grommet 29 will be described now by particular reference to FIGS. 6–8. The grommet 29 may be made from a suitable elastomeric, rubber-like material which is resistant to water and particularly salt water. It may be molded in any manner known in the art and is comprised of a body having a first lower arcuate portion 35 which is generally complementary in shape to the lower portion of the tray cutout 16 and is generally cylindrical in shape. This cylindrical shape is, however, interrupted by a raised circumferential portion 36 which may be slightly tapered to assist in insertion in a groove 37 formed in the tray 13 so as to provide for axial retention of the grommet 29 when installed.

A pair of generally flat sides 38 extend forwardly from a rear face 39 of the grommet 29 and generally upwardly from the curved lower surface 35. As may be best seen in FIG. 5, these flat side portions 38 are generally tangential to the curved portion 35.

The upper peripheral rear portion of the grommet 29 between the flat sides 38 is also generally flat, as indicated at 41 so that the retaining plate 31 when received thereover will retain the grommet in position and slightly compress it.

A forward portion thereof is formed of a generally cylindrical configuration 42 which blends into the overall shape and which defines forwardly thereof a bayonetted-type cylindrical portion 43 having a rib 44 at its forward end and ending in a forward face 45 which is parallel to the rear face 39.

As may be seen best in FIG. 1, this bayonetted portion is adapted to receive a tubular elastic element 46 which can encircle and protect the forward ends of the flexible members 16, 17, 18, and 21.

The upper surface portion 41 is provided, at the rear end thereof, with a longitudinally extending slot 47 that is adapted to receive a downwardly turned portion 48 of the retaining plate 33 so as to hold the grommet 29 against rotation.

In order to pass the flexible elements 16, 17, 18, and 21, and retain them in position, the grommet 29 is provided with a pair of longitudinally extending openings, indicated generally by the reference numerals 49 and 51. These openings extend from the front end face 45 to the rear end face 39. The opening 49, which basically forms a continuous opening, is made up of an upper cylindrical portion 52 which may receive a smaller flexible element such as the throttle wire actuator 18. Immediately beneath it are provided a pair of interconnected larger diameter openings 53 and 54 which may receive the fuel supply line 16. There is further provided a lower, smaller diameter opening 55 which can receive, for example, the transmission wire actuator 21. A further lower and somewhat oval-shaped opening 56 is provided which can receive something such as a bundle of wires or the like for transmitting various signals from sensors in the outboard or to the outboard motor and other similar devices.

Figure 5:
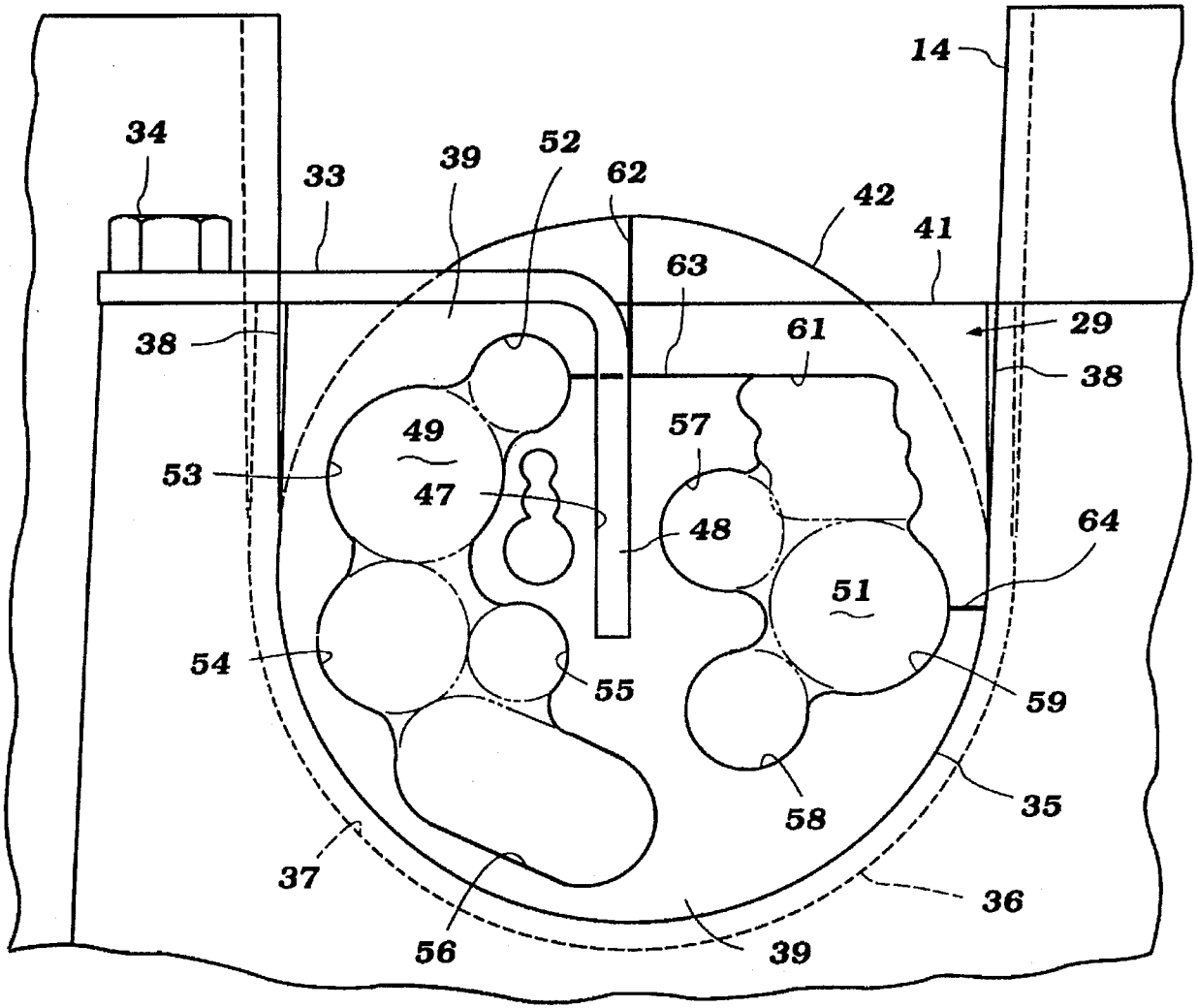
FIG. 5 is a view, in part similar to FIG. 4, but on a larger scale and looking in the opposite direction to show the restraining grommet in position.

As will be seen in FIG. 5, these openings will leave some air space between them, however, when clamped in position the elements will be displaced and the elastic of the grommet 29 will be compressed so as to provide a relatively tight seal.

The opening 51 is comprised of a pair of cylindrical openings 57 and 58 which may carry the fuel return line 17. These will be somewhat smaller in diameter than the supply lines that pass through the openings 53 and 54. A larger opening 59 is formed between the openings 57 and 58 and may pass some other fairly large diameter flexible member. In addition, a generally rectangular opening portion 61 is joined to the opening portions 57, 58, and 59 and completes the opening 51.

Again, the opening portions 57, 58, 59, and 61 will provide some air gaps but these gaps will be substantially closed on compression.

Obviously, it is difficult to insert the various flexible elements through the openings 49 and 51. In accordance with a feature of the invention, there are provided one or more slotted cuts through the body of the flexible grommet 29 so that the grommet 29 may be expanded as shown in FIG. 8 so as to assist in the insertion and removal of the various flexible elements.

For example, there is provided a longitudinally extending slot 62 in this embodiment that extends the full length of the grommet 29 but is disposed between the openings 49 and 51. This slotted opening 62 is intersected by a further transversely extending slot 63 which extends through the openings 49 and 51 at their upper extremities in the area where the slot 62 terminates. As may be seen in FIG. 8, the grommet 29 may be slipped out of the lower tray slot 14 and expanded as shown in FIG. 8 so as to install and remove the flexible elements even when in place in the power head 11. Hence, this construction is much easier to service and still provides an effective seal. A further partial slot 64 may be formed along one side of the grommet 35 and open into the opening 51 so as to further assist in placing larger elements into this opening upon the expansion as shown in FIG. 8.

Figure 9:
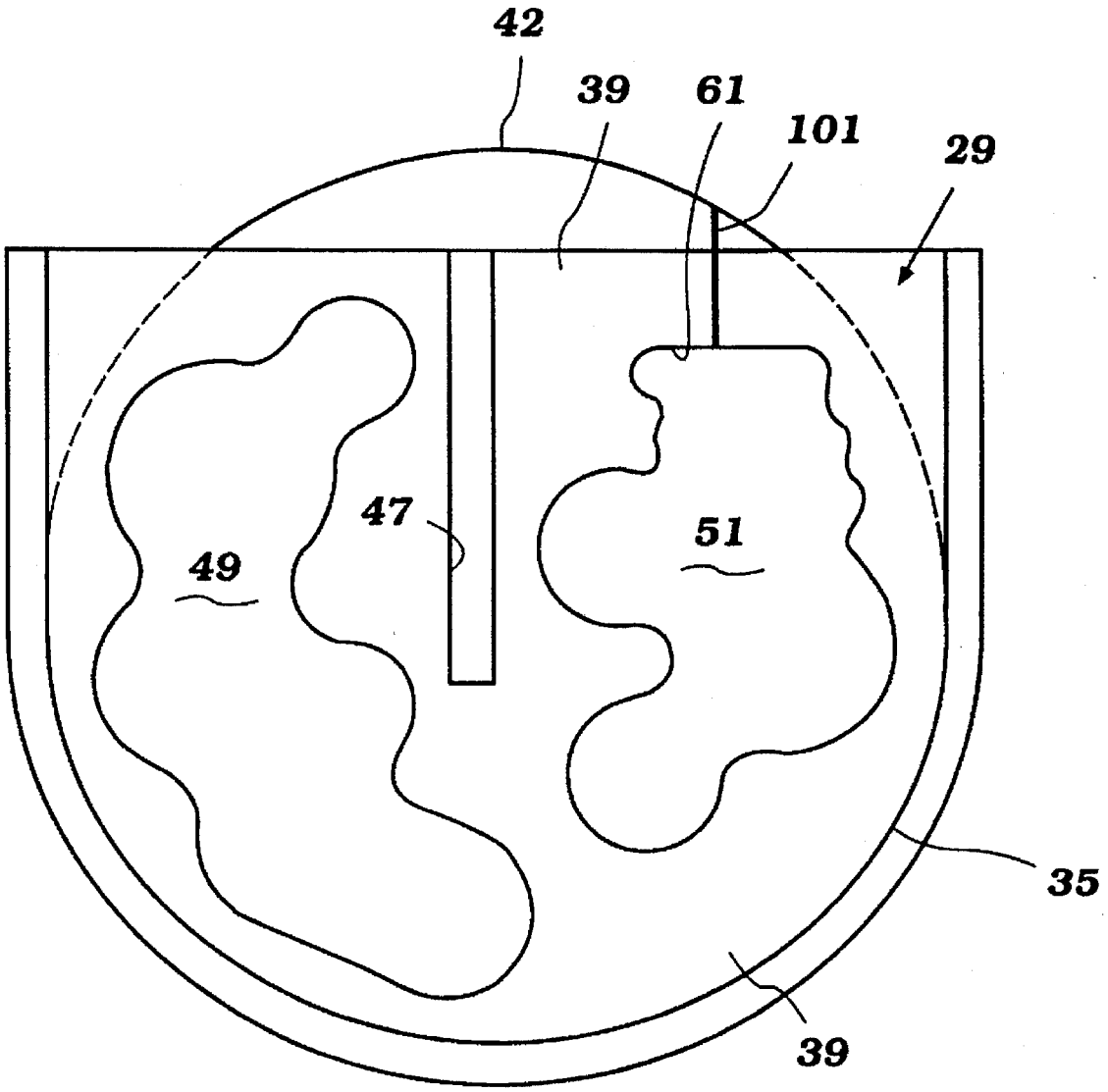
FIG. 9 is an elevational view, in part similar to FIG. 5, and shows another embodiment of the invention.

In the embodiment as thus far described, each of the openings 49 and 51 has been opened by a slit or slotted portion that extends either directly or indirectly to the outer periphery of the elastic grommet 29. In some instances, it may not be necessary to provide such slits for both openings and FIG. 9 shows another embodiment, which is substantially the same as the embodiment thus far described and differs only in this regard. For this reason, components which are the same or substantially the same in this embodiment, have been identified by the same reference numerals. In addition, because of this similarity, only a view similar to that of FIG. 9 is believed to be necessary to those skilled in the art to understand the construction and operation of this embodiment. Also, in this figure, both of the retaining brackets 35 and 31 have been deleted so as to more clearly show the construction.

In this embodiment, only the opening 51 is provided with a slit, indicated generally by the reference numeral 101 which extends generally radially outwardly from the portion 61 of the opening 51 to the outer periphery of the grommet, indicated in this embodiment by the reference numeral 102. In accordance with this embodiment, it is possible to insert and withdraw the flexible elements from the opening 49 by removing one or more of the flexible elements from the opening 51 through the slot 101. This will be sufficient to reduce the compressive pressure on the opening 49 and reflectable elements in them so that they can be easily slid in and out in an axial direction without damaging them. Various other types of slotting arrangements can be utilized to achieve the same result, as will be readily apparent to those skilled in the art.

Thus, from the foregoing description, it should be readily apparent that the embodiments disclosed are effective in providing good water-tight retention around a plurality of flexible elements that extend through an opening in the protective cowling of a marine propulsion unit. In addition, the construction is such that the flexible elements may be inserted or replaced without damage. Of course, the preceding description is that of preferred embodiments of the invention and various changes and modifications may be made without departing from the spirit and scope of the invention as defined by the appended claims.

I claim:

1. A restraining grommet for a marine propulsion unit having a protective cowling having an opening in which said restraining grommet is affixed, said restraining grommet being formed with an outer body of a resilient material, at least two holes extending longitudinally through said body from one end face to the other for passing a respective flexible element between the interior of said protective cowling and the exterior thereof when said restraining grommet is restrained in said protective cowling opening, and a slit extending from only one of said holes to the outer periphery of said restraining grommet for resilient opening of said one hole to insert the respective of said flexible elements into said one hole in a transverse direction, said restraining grommet having sufficient flexibility so as to permit insertion and removal of the respective flexible element from the other hole upon removal of a flexible element from the one hole.

2. A restraining grommet for a marine propulsion unit as set forth in claim 1, wherein at least one of the holes is sized to accept a plurality of flexible elements.

3. A restraining grommet for a marine propulsion unit as set forth in claim 2, wherein the at least one hole is formed with a plurality of shaped sections each sized to accommodate a respective flexible element.

4. A restraining grommet for a marine propulsion unit as set forth in claim 3, wherein both of the holes are configured so as to accommodate a plurality of flexible elements.

5. A restraining grommet for a marine propulsion unit as set forth in claim 1, further including an additional slotted opening formed in the restraining grommet and adapted to receive a bracket for affixing the restraining grommet to the protective cowling and for precluding rotation of the restraining grommet.

6. A restraining grommet for a marine propulsion unit as set forth in claim 1, wherein one end of the restraining grommet is formed with an extending tubular portion adapted to receive a flexible boot for passing the flexible elements therethrough.

7. A restraining grommet for a marine propulsion unit as set forth in claim 6, wherein the tubular portion is barbed.

* * * * *